US006779288B1

(12) United States Patent
Kim

(10) Patent No.: US 6,779,288 B1
(45) Date of Patent: Aug. 24, 2004

(54) ACCESSORY MOUNTS FOR FIREARMS

(75) Inventor: Paul Y. Kim, Irvine, CA (US)

(73) Assignee: Surefire, LLC, Fountain Valley, CA (US)

( * ) Notice: Subject to any disclaimer, the term of this patent is extended or adjusted under 35 U.S.C. 154(b) by 0 days.

(21) Appl. No.: 10/447,874

(22) Filed: May 29, 2003

(51) Int. Cl.[7] ..... F41C 23/00
(52) U.S. Cl. ..... 42/72; 42/124; 42/75.01
(58) Field of Search ..... 42/85, 75.03, 73, 42/72, 124, 125, 75.01; 89/1.42

(56) References Cited

U.S. PATENT DOCUMENTS

| | | | | | |
|---|---|---|---|---|---|
| 2,128,936 | A | | 9/1938 | Green | 89/14.2 |
| 2,287,066 | A | | 6/1942 | Rogers | 89/14 |
| 2,965,994 | A | | 12/1960 | Sullivan | 42/71 |
| 3,075,314 | A | | 1/1963 | Bakker | 42/71 |
| 3,090,150 | A | | 5/1963 | Stoner | 42/71 |
| 3,838,522 | A | * | 10/1974 | Williams | 42/137 |
| 3,857,323 | A | | 12/1974 | Ruger et al. | 89/191 |
| 4,536,982 | A | | 8/1985 | Bredbury et al. | 42/71 |
| 4,627,183 | A | | 12/1986 | Stuckman | 42/1.01 |
| 4,663,875 | A | | 5/1987 | Tatro | 42/71.01 |
| 4,733,489 | A | | 3/1988 | Kurak | 42/77 |
| 4,742,636 | A | | 5/1988 | Swan | 42/126 |
| 4,756,111 | A | * | 7/1988 | Lapier | 42/128 |
| 4,845,871 | A | | 7/1989 | Swan | 42/127 |
| 4,941,277 | A | | 7/1990 | Lawlor | 42/112 |
| 5,010,676 | A | | 4/1991 | Kennedy | 42/71 |
| 5,052,141 | A | * | 10/1991 | Sammons | 42/69.01 |
| 5,092,071 | A | | 3/1992 | Moore | 42/85 |
| 5,111,587 | A | | 5/1992 | Plank | |
| 5,142,806 | A | | 9/1992 | Swan | 42/114 |
| 5,198,600 | A | | 3/1993 | E'Nama | 42/90 |
| 5,201,135 | A | | 4/1993 | Cowles | 42/129 |
| 5,343,650 | A | | 9/1994 | Swan | 42/117 |
| 5,400,540 | A | | 3/1995 | Solinsky et al. | 42/115 |
| 5,522,166 | A | | 6/1996 | Martel | 42/124 |
| 5,533,292 | A | | 7/1996 | Swan | 42/123 |
| 5,590,484 | A | | 1/1997 | Mooney et al. | 42/111 |
| 5,634,288 | A | | 6/1997 | Martel | 42/71 |
| 5,704,155 | A | | 1/1998 | Primeau, IV | 42/114 |
| 5,758,448 | A | * | 6/1998 | Thummel | 42/114 |
| 5,826,363 | A | | 10/1998 | Olson | 42/75 |
| 5,918,374 | A | * | 7/1999 | Campbell et al. | 42/137 |
| 5,937,562 | A | | 8/1999 | Brough | 42/119 |
| 6,012,374 | A | | 1/2000 | Brandl et al. | 89/1.41 |
| 6,345,464 | B1 | | 2/2002 | Kim et al. | 42/114 |
| 6,385,892 | B1 | | 5/2002 | Vendetti | 42/86 |
| 6,442,883 | B1 | | 9/2002 | Waterman et al. | 42/124 |
| 6,508,027 | B1 | | 1/2003 | Kim | 42/124 |

OTHER PUBLICATIONS

United States Department of Defense, Military Standard: Dimensioning of Accessory Mounting Rail for Small Arms Weapons, MIL–STD– 1913, Feb. 3, 1995.

* cited by examiner

*Primary Examiner*—Michael J. Carone
*Assistant Examiner*—Denise J Buckley
(74) *Attorney, Agent, or Firm*—David Weiss

(57) ABSTRACT

An accessory mount for a firearm, and a method for installing the accessory mount to the firearm. In combination with the firearm including a longitudinal barrel, a rear support and a front support, the accessory mount includes a first semicylindrical mount housing having two longitudinal edges, an inner surface and a rear end, the first housing positioned along the barrel with its rear end supported by the firearm's rear support, and including longitudinally spaced-apart lugs on the inner surface adjacent to each of the first housing's edges; a second semicylindrical mount housing having two longitudinal edges and a front end, and including longitudinally spaced-apart appendages adjacent to each of the edges of the second housing, the second housing placed to the first housing with the appendages cooperating with the lugs for transversely securing the first housing to the second housing and with the first and second housings longitudinally movable relative to each other; and at least one longitudinally adjustable member carried by one of the housings longitudinally urging the first housing's rear end against the firearm's rear support and longitudinally urging the second housing's front end against the firearm's front support.

28 Claims, 4 Drawing Sheets

ACCESSORY MOUNTS FOR FIREARMS

BACKGROUND OF THE INVENTION

This invention relates to accessory mounts for firearms, and more particularly to accessory mounts that may be quickly, easily and firmly secured to a firearm, and quickly and easily removed therefrom.

Various types of devices are useful as accessories for being mounted to firearms, examples of such accessories being target illuminators, laser sights and vertical handgrips. Such accessories are conventionally mounted to an interface apparatus descriptively referred to as an accessory mount, which has been secured to the firearm. Such accessory mounts may include rail interface systems well known in the art pertaining to firearms, and in particular with respect to submachine guns, carbines, rifles and other firearms used for military and police operations.

SUMMARY OF THE INVENTION

Against this background, the present invention provides an accessory mount that may be firmly secured to a firearm along the firearm's barrel, and which is quickly and easily securable to and removable from the firearm. According to one aspect of the present invention, there is provided an accessory mount for a firearm having a longitudinal barrel, a rear support at the firearm's receiver, and a front support, the accessory mount comprising the combination of: a first longitudinal mount housing having a rear end, the first housing positionable along the firearm's barrel with the first housing's rear end supported by the firearm's rear support; a second longitudinal mount housing having a front end, the second housing positionable along the barrel with the second housing's front end in the vicinity of the firearm's front support; a plurality of inwardly directed longitudinally spaced-apart lugs on one of the first and second housings; a plurality of outwardly directed longitudinally spaced-apart flanges on the other of the first and second housings cooperating with the lugs for transversely securing the first and second housings together when the second housing is placed to the first housing and the first and second housings are longitudinally displaced relative to each other; and at least one adjustable member carried by one of the first and second housings and cooperating with the other of the first and second housings for longitudinally displacing the first and second housings relative to each other. The housing which includes the lugs further includes longitudinal channels along such lugs for slidingly containing the flanges of the other housing. At least one of the first and second housings includes a rail structure for mounting a firearm accessory thereto.

The at least one adjustable member is controlled by a user for urging the first housing longitudinally toward the firearm's rear support, while urging the second housing longitudinally toward the firearm's front support, longitudinally locking the transversely secured-together first and second housings against and between the firearm's rear support and front support.

In a preferred embodiment of the present invention, there is provided an accessory mount for a firearm having a longitudinal barrel, a rear support and a front support, the accessory mount comprising the combination of: a first semicylindrical mount housing having two longitudinal edges, an inner surface and a rear end, the first housing positionable along the firearm's barrel with the first housing's rear end supported by the firearm's rear support, the first housing including longitudinally spaced-apart lugs on the inner surface adjacent to each of the edges; a second semicylindrical mount housing having two longitudinal edges and a front end, the second housing including longitudinally spaced-apart appendages adjacent to each of the edges of the second housing; the lugs being positioned on the first housing and the appendages being positioned on the second housing for cooperation between the lugs and the appendages when the second housing is placed to the first housing, for transversely securing the first housing to the second housing with the first housing and the second housing longitudinally movable relative to each other; and at least one longitudinally adjustable member carried by one of the housings for urging the first housing and the second housing in longitudinally opposite directions. The at least one longitudinally adjustable member urges the rear end of the first housing toward the firearm's rear support while urging the front end of the second housing toward the firearm's front support.

According to a further aspect of the present invention, there is provided firearm and accessory mount apparatus, comprising in combination: a firearm including a longitudinal barrel, a rear support and a front support; a first semicylindrical mount housing having two longitudinal edges, an inner surface and a rear end, the first housing positioned along the barrel with the first housing's rear end supported by the firearm's rear support, the first housing including longitudinally spaced-apart lugs on the inner surface adjacent to each of the edges; a second semicylindrical mount housing having two longitudinal edges and a front end, the second housing including longitudinally spaced-apart appendages adjacent to each of the edges of the second housing, the second housing placed to the first housing with the appendages of the second housing cooperating with the lugs of the first housing for transversely securing the first housing to the second housing with the first housing and second housing longitudinally movable relative to each other; and at least one longitudinally adjustable member carried by one of the housings longitudinally urging the rear end of the first housing against the firearm's rear support and longitudinally urging the front end of the second housing against the firearm's front support. The first housing includes two longitudinal channels defined by the lugs respectively adjacent the longitudinal edges of the first housing, and the appendages of the second housing include flanges slidably contained in the channels.

The present invention further provides a method of installing an accessory mount to a firearm, a preferred manner of practicing the invention comprising the steps of: providing a firearm having a longitudinal barrel, a rear support and a front support; providing a first semicylindrical mount housing having two longitudinal edges, an inner surface, a rear end, and longitudinally spaced-apart lugs on the inner surface adjacent the longitudinal edges of the first housing, the lugs defining two longitudinal channels therealong; positioning the first housing along the barrel with the first housing's rear end supported by the firearm's rear support; providing a second semicylindrical mount housing having two longitudinal edges, a front end, and longitudinally spaced-apart appendages adjacent to each of the edges of the second housing, the appendages including outwardly transverse flanges; placing the second housing to the first housing with the flanges positioned between the lugs and with the flanges slidably contained in the channels; and urging the first housing and the second housing in longitudinally opposite directions such that the flanges cooperate with the lugs for transversely securing the first and second housings to each other, the first housing's rear end is longitudinally urged against the firearm's rear support, and the second housing's front end is longitudinally urged against the firearm's front support. During the housing providing steps, at least one of the housings includes a rail structure for mounting a firearm accessory thereto.

BRIEF DESCRIPTION OF THE DRAWINGS

The novel features believed to be characteristic of the invention, together with further advantages thereof, will be better understood from the following description considered in connection with the accompanying drawings in which preferred embodiments of the present invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENTS

Figure 1:
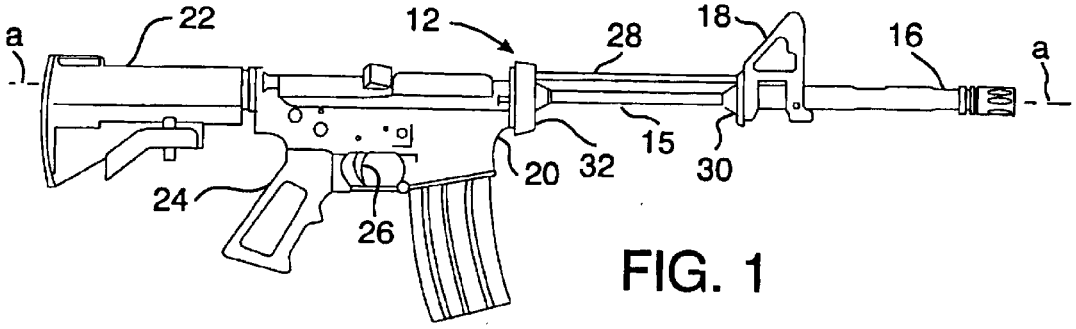
FIG. 1 is a side elevation view of an example of a firearm to which a preferred embodiment of an accessory mount according to the present invention may be secured.
Figure 2:
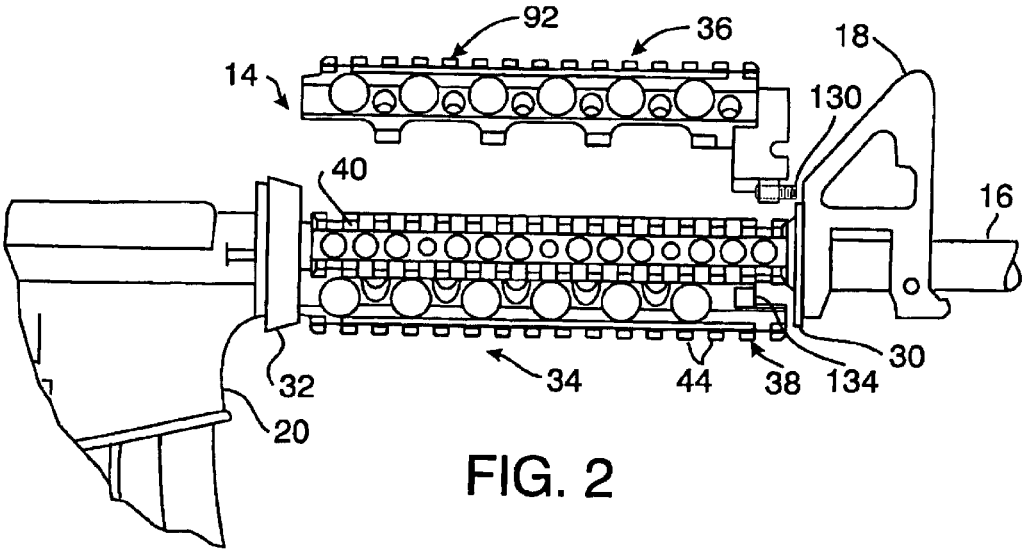
FIG. 2 is an enlarged fragment of the firearm of FIG. 1, showing a preferred accessory mount embodiment of the present invention in process of being secured thereto.

Turning first to FIGS. 1 and 2, there is illustrated an example of a firearm 12, such as an M-4 or M-16 automatic rifle, the M-4 rifle being shown in the example of FIG. 1, to which a preferred embodiment of an accessory mount 14 may be equipped in the manner illustrated in FIG. 2. The accessory mount 14 is secured to the firearm 12 and surrounds a section 15 of the firearm's barrel 16 along the firearm's fore-end section between the firearm's front sight 18 and receiver 20. The firearm 12 further includes a stock 22, pistol grip 24 and trigger 26. Such automatic rifles 12 are well known in the firearms art, and typically include a gas tube 28 above the barrel 16 and extending between the receiver 20 and the firearm's handguard forward support cup 30. M-4 and M-16 rifles typically include a handguard rear slip ring or support cup 32 at the receiver 20 with a barrel nut (not shown) at the rear end of the barrel 16.

As used herein, the word "front" or "forward" describes a direction toward the muzzle of the barrel 16 (i.e., to the right as shown in FIGS. 1 and 2); "rear" or "rearward" describes the direction opposite the front (i.e., to the left as shown in the drawing of FIGS. 1 and 2); "above" or "upper" means vertically above when the firearm 12 is in a firing position with its barrel 16 horizontal; "below" or "lower" means vertically below when the firearm 12 is in a firing position with its barrel 16 horizontal; "longitudinal" means the direction along or parallel to the longitudinal axis a of the barrel 16 or the longitudinal axes of the accessory mount 14 or mount housing 34, 36; and "transverse" means a direction perpendicular to a longitudinal direction.

Turning to FIGS. 2–15, the accessory mount 14 includes a generally semicylindrical first shell or housing 34 and a generally semicylindrical second shell or housing 36. The term "semicylindrical" is used herein in its broad sense as denoting a partial cylindrical configuration, i.e. the housing 34 or 36 may have a transverse cross-sectional configuration describing an arc greater than or less than 180°, as well as describing an arc of 180°. In the preferred embodiment, the transverse cross-sectional configuration of the first housing shown as a lower housing 34 describes an arc greater than 180°, while the transverse cross-sectional configuration of the second housing shown as an upper housing 36 describes an arc less than 180°.

The first or lower mount housing 34 extends along a longitudinal axis a', and includes at least one longitudinal rail structure therealong such as a bottom rail structure 38 along the exterior underside thereof, and which also may include side rail structures 40, 42, to which may be mounted one or more firearm accessories such as a target illuminator, a laser sight, a handgrip, and other devices.

Figure 3:
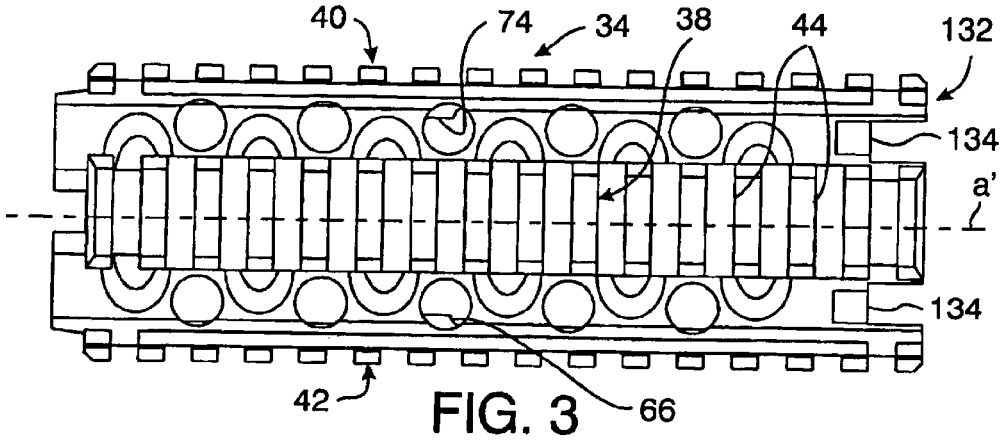
FIG. 3 is a bottom plan view of a preferred embodiment of a first or lower mount housing forming a part of the accessory mount preferred embodiment shown in FIG. 2, in increased scale.
Figure 4:
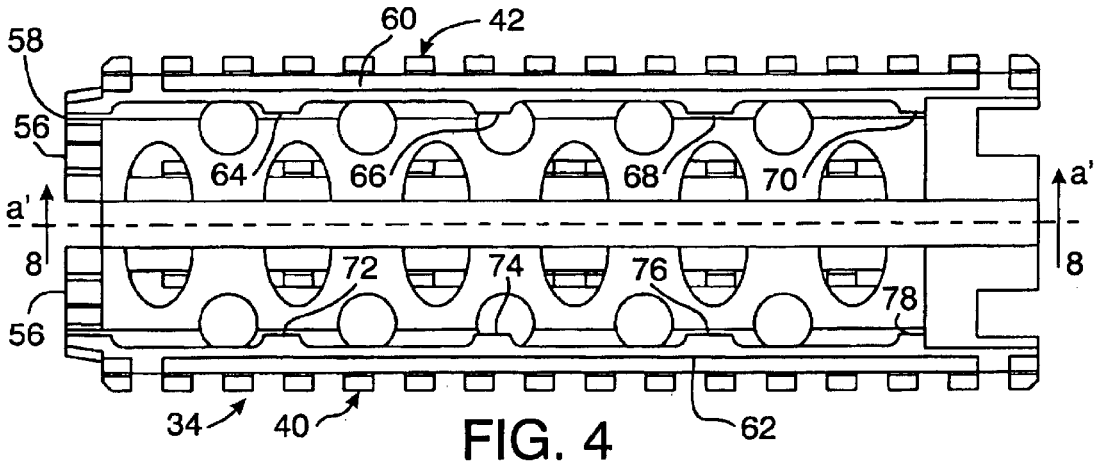
FIG. 4 is a top plan view of the lower mount housing of FIG. 3.
Figure 5:
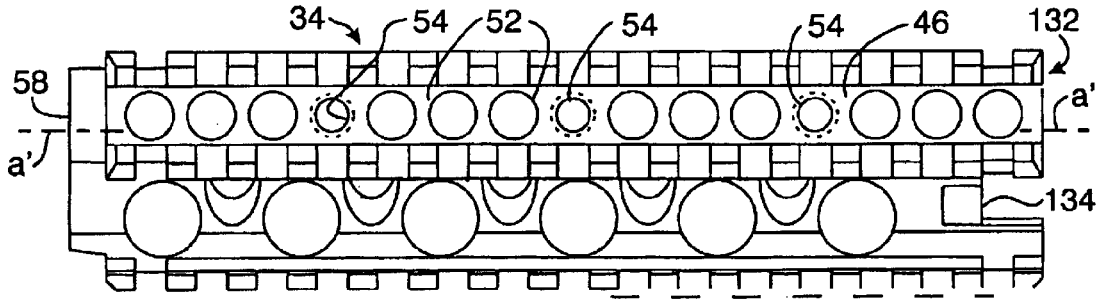
FIG. 5 is a side elevation view of the lower mount housing.
Figure 6:
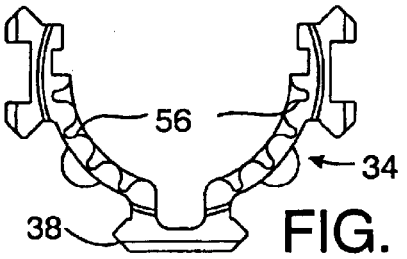
FIG. 6 is a rear elevation view of the lower mount housing.
Figure 7:
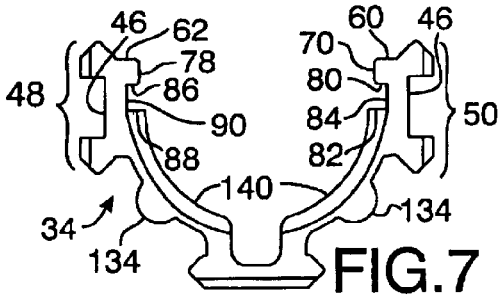
FIG. 7 is a front elevation view of the lower mount housing.

Rails for accessory mounts are well known in the firearms art, for example as contained in rail interface system devices such as manufactured by Knights Manufacturing Company (of Vero Beach, Fla.), including those disclosed in U.S. Pat. No. 5,826,363 of Douglas D. Olson, as well as those disclosed in U.S. Pat. No. 5,590,484 of Aurelius A. Mooney et al., both of which patents are incorporated herein by reference. One such prior art rail comprises a series of longitudinally spaced-apart ribs 44 (FIG. 3), such as specified in MIL-STD-1913 and commonly known as a Picatinny rail, which is shown in FIGS. 2 and 3 as comprising the bottom rail 38. Such Picatinny rails may be used for the side rail structures 40, 42 as well, which Picatinny rails may be modified by including a slot or channel 46 (see FIGS. 5 and 7) longitudinally extending along the lower mount housing 34 through the ribs 48 and 50, such ribs being oriented perpendicular to the longitudinal axis a'. Either type of rail structure may be utilized for securing accessories having a Weaver style or other cooperating clamping device, although the provision of the channel 46 permits greater adaptability of accessory arrangement on a rail as well as additional types of securement opportunities. Further, the housing wall of each channel 46 may include apertures 52 therethrough, for weight and/or heat reducing purposes, as well as longitudinally spaced-apart apertures 54 preferably with internal threads for the securement of accessories by other securement devices (e.g. screws) instead of or in addition to securement by utilization of the rails 38, 40, 42 alone. Such rail structures 40, 42 are described in U.S. Pat. No. 6,508,027 of Paul Y. Kim, which patent is incorporated herein by reference.

Figure 15:
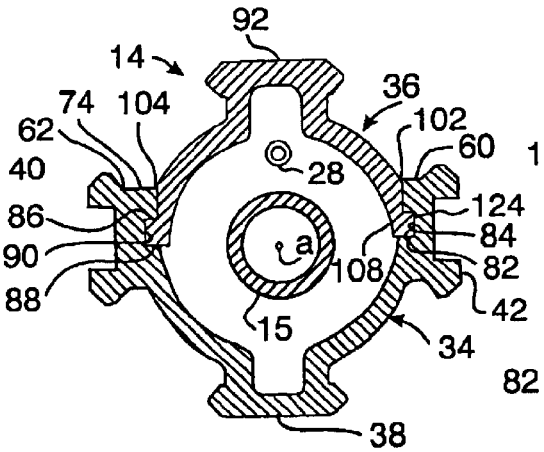
FIG. 15 is a section of the assembled accessory mount of FIG. 14, taken along the line 15—15 of FIG. 14 and viewed in the direction of the appended arrows.

The lower mount housing 34 is adapted to be longitudinally positioned and secured to the firearm 12 laterally about and below the section 15 of the barrel 16 extending substantially from the receiver 20 to the vicinity of the front handguard support cup which in turn is supported at the front sight post 18; i.e., the lower mount 34 is positioned along the barrel 16 such that the barrel section 15 longitudinally extends within the interior of the lower housing 34 as illustrated in FIGS. 2 and 15 (the gas tube 28 not being shown in FIG. 2 for clarity of presentation). The lower mount housing 34 includes a rear end portion 58 having at least one and preferably two rearwardly extending projections'such as the arcuate scalloped tabs 56 (see FIGS. 4 and 6) positioned and dimensioned for being inserted into the handguard rear cup 32 along mating scallops of the conventional scalloped barrel nut so as to cause the lower mount housing's rear end 58 to be supported by the receiver 20 when the mount 14 is to be installed on the firearm 12.

The lower mount housing 34 includes two upper longitudinal edges 60, 62 along the respective sides thereof. A plurality of longitudinally spaced-apart first protuberances or lugs, illustrated by the first lugs 64, 66, 68, 70 shown best in FIGS. 4 and 8, transversely project inwardly along the inner surface of the lower mount housing 34 adjacent to the lower housing's first longitudinal edge 60. A plurality of longitudinally spaced-apart second protuberances or lugs 72, 74, 76, 78 (FIG. 4) transversely project inwardly along the inner surface of the lower mount housing 34 adjacent to the lower housing's second longitudinal edge 62.

The bottom surfaces 80 of the first lugs 64, 66, 68, 70 are longitudinally aligned with each other and spaced by a distance h above a series of transverse ledges 82 longitudinally aligned along the inner surface of the lower housing 34, defining a longitudinal channel 84 (FIG. 7) of height h (FIG. 8) in the wall of the lower housing 34 preferably along substantially its entire length. Similarly, the bottom surfaces 86 of the second lugs 72, 74, 76, 78 are longitudinally aligned above a series of transverse ledges 88 (FIG. 7) similar to the transverse ledges 82, along the inner surface of the lower housing 34 to define a longitudinal channel 90 (FIG. 7) of preferably the same height h as the channel 84, in the lower housing wall.

The second or upper mount housing 36 (FIGS. 9–13) extends along a longitudinal axis a", and includes at least one longitudinal rail structure, preferably a top rail structure 92 along the exterior top thereof, which top rail structure 92 may be similar to the bottom rail structure 38 of the lower housing 34, such as comprising a Picatinny rail as previously described.

The upper mount housing 36 is adapted to be longitudinally positioned and secured to the lower mount housing 34, laterally about and above the section 15 of the barrel 16 extending substantially from the vicinity of the receiver 20 to the front support cup 30 when the lower mount 34 is supported by the rear cup 32 at the receiver 20, the upper mount housing 36 being preferably of substantially the same length as the lower mount housing 34. The upper housing 36 includes a rear end portion 94 having at least one and preferably two rearwardly extending projections such as the arcuate tabs 96 insertable into the rear cup 32. The upper housing front end portion 98 includes at least one and preferably two forwardly extending projections such as the forwardly extending tabs 100 for engaging the firearm's front support which, in the case of an M-4 or M-16 automatic rifle, is exemplified by the front cup 30.

The upper mount housing 36 includes two lower longitudinal edges 102, 104 along its respective sides. A plurality of longitudinally spaced-apart first appendages, illustrated by the first appendages 106, 108, 110, 112 (FIG. 13) extend or depend from the upper housing's first lower longitudinal edge 102 in the same manner as does a like plurality of longitudinally spaced-apart second appendages, illustrated by the appendages 114, 116, 118, 120 (FIGS. 9 and 13) extending or depending from the upper housing's second longitudinal edge 104.

Each of the appendages 106–120 comprises a tang 122 (see, for example, FIGS. 9 and 11) extending or depending from its respective longitudinal edge 102 or 104, each tang 122 preferably being arcuate or following the curvature of the semicylindrical upper housing 36. Each tang 122 terminates with an outwardly transverse flange 124 having an upper surface 126 and a lower surface 128. The vertical distance between the upper surface 126 and the lower surface 128 is slightly less than the height h of the longitudinal channel 84 or 90 in the lower mount housing 34, and the dimensions of the upper mount housing 36 are related to the dimensions of the lower mount housing 34 such that the flanges 124 of the first appendages 106–112 slip-fit into and along the lower housing's first longitudinal channel 84 and the flanges 124 of the second appendages 114–120 slip-fit into and along the lower housing's second longitudinal channel 90, when the upper housing 36 is placed to the lower housing 34 with their respective first longitudinal edges 60 and 102 adjacent to one another and with their respective second longitudinal edges 62 and 104 adjacent to one another, as represented in FIG. 15. When the upper housing 36 is so placed to the lower housing 34, the upper housing's longitudinal axis a" preferably coincides with the lower housing's longitudinal axis a'.

One of the mount housings 34 or 36 is provided with an adjustment device for urging the two housings in longitudinally opposite directions. In the preferred embodiment, the front end portion 98 of the second or upper housing 36 includes at least one and preferably two threaded longitudinal bores 129 therethrough, each longitudinally carrying a set screw 130 (see FIGS. 9 and 12). The forward end portion 132 of the lower mount housing 34 includes two forwardly-facing transverse bearing surfaces 134 (see FIGS. 3, 5, 7 and 14) longitudinally aligned with the respective threaded bores 129 of the upper mount housing forward end 98 such that the tail ends 136 of the set screws 130 are caused to bear against the respective bearing surfaces 134 when the upper housing 36 is placed to the lower housing 34 and the set screw 130 is caused to be rearwardly displaced or screwed into the bores 129.

When installing the accessory mount 14 on the firearm 12, the user positions the lower mount housing 34 such that its longitudinally extending rear projections or arcuate tabs 56 are inserted in the handguard rear cup 32 at the firearm's receiver 20. The length of each of the arcuate tabs 56 is preferably slightly greater than the longitudinal depth of the rear cup 32, and when positioned as described the lower housing rear end 58 is supported by the outer circumferential wall of the rear support cup 32, as shown in FIG. 2.

The upper mount housing 36 is placed upon the lower mount housing 34, with the upper housing's lower longitudinal edges 102, 104 adjacent to the lower housing's upper longitudinal edges 60, 62, respectively, with the upper housing's rearwardly extending tabs 96 inserted into the rear cup 32 and the upper housing's forwardly extending tabs 100 positioned for being inserted into the front support cup 30.

Figure 8:
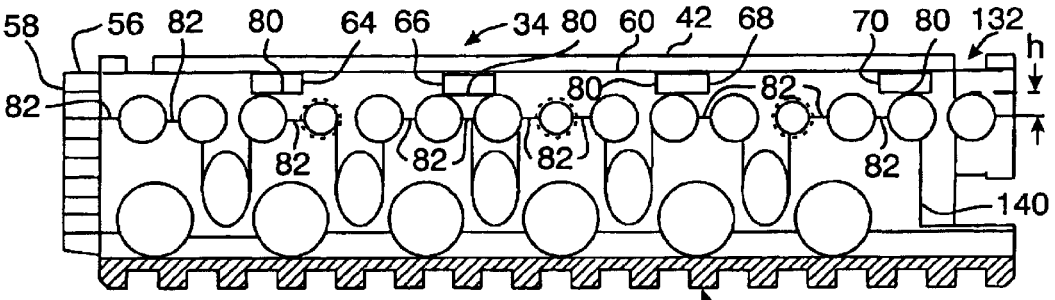
FIG. 8 is a section of the lower mount housing, taken along the line 8—8 of FIG. 4 and viewed in the direction of the appended arrows.
Figure 9:
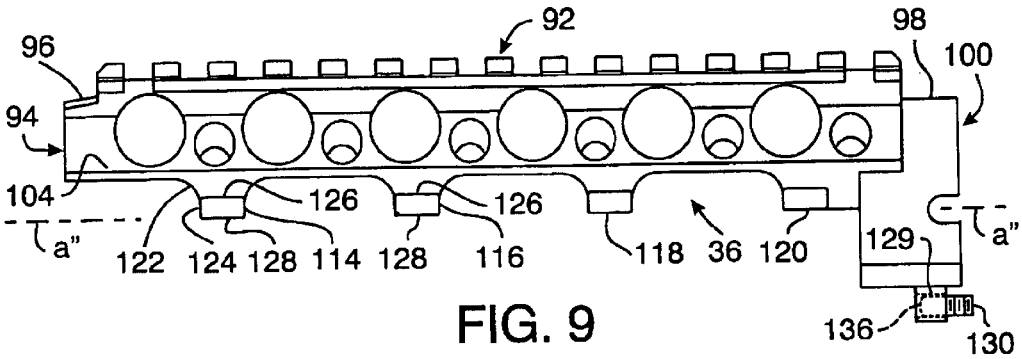
FIG. 9 is a side elevation view of a preferred embodiment of a second or upper mount housing forming a part of the accessory mount embodiment shown in FIG. 2, in increased scale.
Figure 10:
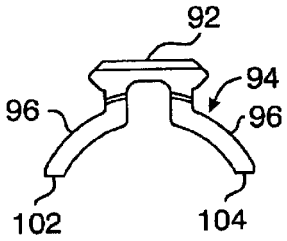
FIG. 10 is an elevation view of the rear end of the upper mount housing of FIG. 9.
Figure 11:
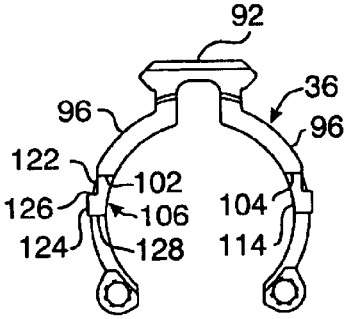
FIG. 11 is a rear elevation view of the upper mount housing.
Figure 12:
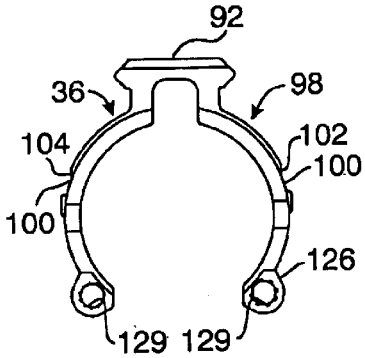
FIG. 12 is a front elevation view of the upper mount housing.
Figure 13:
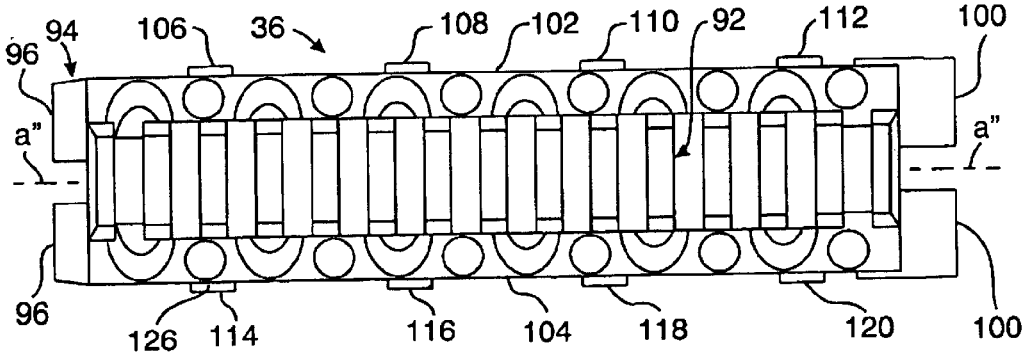
FIG. 13 is a top plan view of the upper mount housing.

As previously indicated, the opposed transverse walls of each of the longitudinal channels 84, 90 of the lower housing 34 are discontinuous, comprising the longitudinally aligned spaced-apart respective bottom surfaces of the lugs 80, 86 and the ledge segments 82, 88, as shown in FIG. 8. The length of each of the first and second lugs 64–78 and of the flanges 124, and their longitudinal spacing along the lower and upper housings, are such that the flanges 124 of the first and second appendages 102–120 may be directed into their respective channels 84, 90 by the flanges 124 being passed through discontinuities created by the longitudinal spacing of the lugs when the upper housing 36 is placed to the lower housing 34 during installation.

At this initial installation position, the flange of each of the appendages is positioned in its appropriate channel 84 or 90 and just rearwardly of its corresponding lug. At this point, the user adjusts the setscrews 130 for causing their tail ends 136 to contact the lower housing's bearing surfaces 134. Continued screwing of the set screws 130 through the threaded bores 129 urges the lower housing 34 and the upper housing 36 in opposite directions, the upper housing 36 longitudinally moving in the forward direction relative to the lower housing 34, with the flanges 124 longitudinally sliding along their appropriate channel 84, 90 acting as tracks for the flanges. Such relative movement of the two housings urges the lower housing 34 rearwardly and the upper housing 36 forwardly.

The longitudinal spacing of the lugs and flanges are such that longitudinal forward movement of the upper housing 36 relative to the lower housing 34, from the initial installation position, causes the upper surfaces 126 of each of the flanges 124 of the appendages 106–120 to contact respective bottom surfaces 80, 86 of the lugs 64–78. In addition, the bottom surfaces 128 of the flanges 124 of at least two (and preferably all) of the first appendages 106–112 contact ledges 82 along the first channel 84, and the bottom surfaces 128 of the flanges 124 of at least two (and preferably all) of the second appendages 114–120 contact the ledges 88 along the second channel 90. In such manner, the flanges 124 of the appendages 106–120 arc captured between their respective lugs 64–78 and ledges 82, 88 (i.e. within their respective channels 84, 90), preventing transverse movement while permitting longitudinal movement of the upper housing 36 with respect to the lower housing 34.

Figure 14:
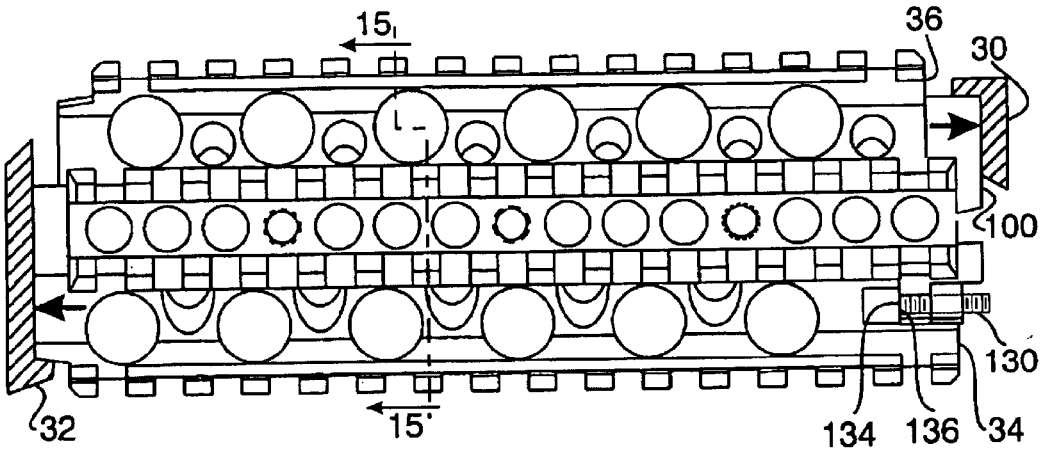
FIG. 14 is a side elevation view of the lower and upper mount housings assembled together.

Such longitudinal relative movement of the two housings 34, 36 further urges the rearwardly facing edges of the lower housing's rear tabs 56 against the firearm's rear support cup 32 at the receiver 20 while urging the upper housing's forwardly extending tabs 100 into and against the forward support cup 30, thereby longitudinally clamping the combined upper housing 36 and lower housing 34 (i.e. the accessory mount 14) to and between the firearm's rear support cup 32 at the receiver 20 and the firearm's forward support cup 30. The amount of longitudinal adjustment by the set screws 130 is controlled by the user to produce relative longitudinal movement between the upper housing 36 and the lower housing 34 so as to cause the flanges 124 to be forwardly positioned along their appropriate channels 84, 90 beneath their corresponding lugs, as described above and as exemplified in FIG. 15, causing the upper housing 36 and the lower housing 34 to be transversely secured together. Specifically, the flanges 124 of the first appendages 106, 108, 110, 112 extend into the lower housing's first channel 84 and are situated beneath and contacting the respective first lugs 64, 66, 68, 70, while the flanges 124 of the second appendages 114, 116, 118, 120 extend into the lower housing's second longitudinal channel 90 and are situated beneath and contacting the respective second lugs 72, 74, 76, 78. The accessory mount 14 is installed on the firearm 12 as shown in FIGS. 14 and 15, the longitudinal axes a, a'and a" preferably coinciding with one another.

The accessory mount 14 may be quickly and easily removed from the firearm 12 by reversing the installation procedure, i.e. by the user unscrewing or forwardly adjusting the set screws 130 sufficiently to release the ends 100 and 56 from their pressure contact with the respective handguard front and rear supports 30, 32, and for longitudinally displacing the flanges 124 from the lugs 64–78. The upper housing 36 may then be upwardly removed from the lower housing 34, whereupon the lower housing 34 may be removed from the firearm 12, The lower housing 34 and the upper housing 36 may be manufactured using fabrication methods well known in the art, of well known of materials typically used in the art of making firearm accessory mounts including metals such as light weight aluminum alloys and other rigid and durable materials such as polymeric materials.

Although the M-4 and M-16 automatic rifles have been exemplified herein, the accessory mount of the present invention may be fitted for being installed on other types of firearms.

Although the first housing 34 has been described as a lower housing and the second housing 36 has been described as an upper housing, these housings may be placed laterally along the firearm barrel 16 rather than vertically therealong. Further, the housings 34, 36 may be placed along the firearm barrel 16 such that they are vertically reversed, i.e. the first housing 34 is situated above the second housing 36.

Figure 16:
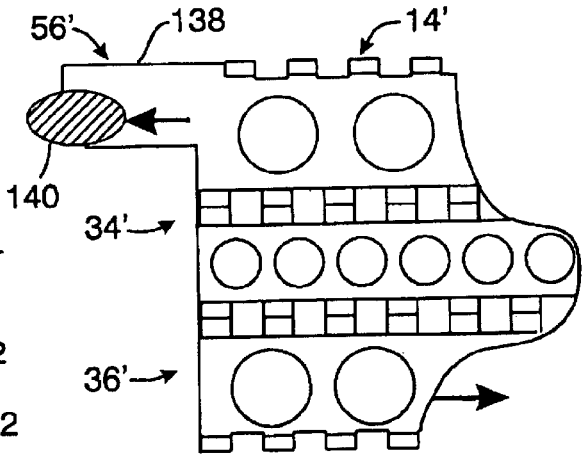
FIG. 16 is a fragment of a second preferred embodiment of an accessory mount according to the present invention, adapted for use with another type of firearm.
Figure 4:
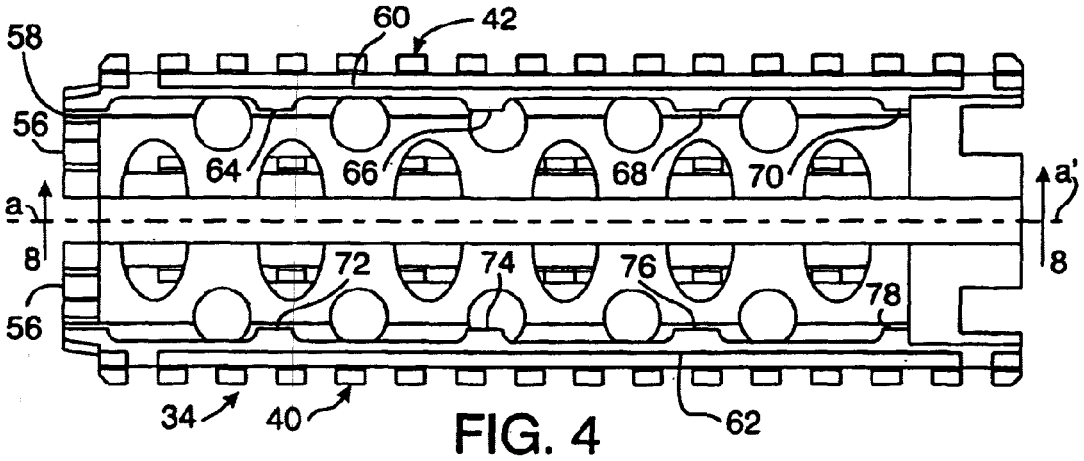
Figure 5:
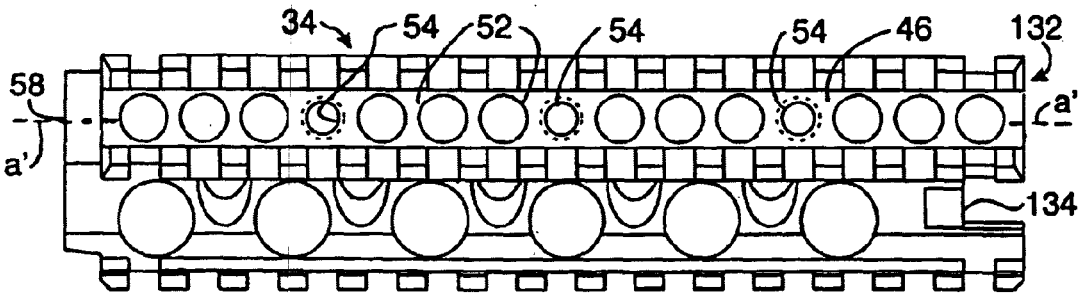
Figure 6:
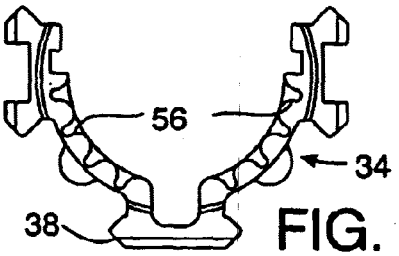
Figure 7:
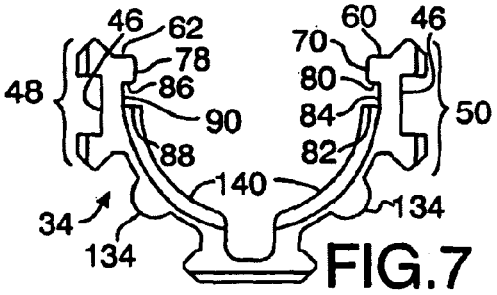
Figure 8:
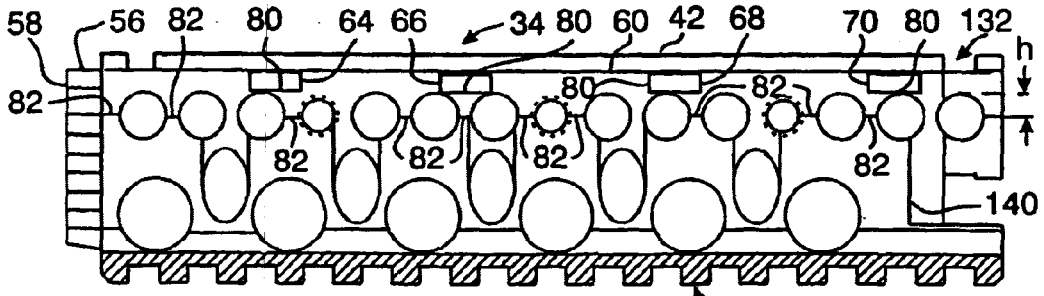

FIG. 16 is a fragment of a rear portion of an accessory mount 14' where the first mount housing 34' is vertically above the second mount housing 36'. In this embodiment, the rear end 56' of the first housing 34' includes rear extensions 138 configured for mating with a horizontal post 140 (shown in cross-section) at the firearm's receiver, for example of the type carried by a Sig Sauer 551 rifle. Such horizontal post 140 at the firearm's receiver provides the rear support for the accessory mount 14', serving the same rear support purpose as does the rear slip ring or cup 32 of the M-4 or M-16 rifles as previously described. When the first mount housing 34' is placed to the rifle barrel with its rear extension upon and supported by the rifle's horizontal post 142, the second mount housing 36' is then placed beneath and to the first housing 34' with their respective lugs and flanges disposed for interacting as previously described. Relative movement of the two housings 34', 36' urges the rear extensions 138 rearwardly against the firearm's horizontal post 140 at the firearm's receiver while urging the second housing's front end portion 98 into and against a front support cup, as indicated by the arrows in FIG. 16.

Thus, there have been described preferred embodiments of an accessory mount that may be easily, quickly and firmly secured to a firearm, and quickly and easily removed from the firearm, as well as a preferred method of installing the accessory mount on the firearm. Other embodiments of the present invention, and variations of the embodiments presented herein, may be developed without departing from the essential characteristics thereof. Accordingly, the invention should be limited only by the scope of the claims listed below.

I claim:

1. An accessory mount for a firearm having a longitudinal barrel, a rear support and a front support, the accessory mount comprising the combination of:

a first longitudinal mount housing having a rear end, said first housing positionable along the barrel with said rear end of said first housing supported by the rear support;

a second longitudinal mount housing having a front end, said second housing positionable along the barrel with said front end of said second housing in the vicinity of said front support;

a plurality of inwardly directed longitudinally spaced-apart lugs on one of said first and second housings;

a plurality of outwardly directed longitudinally spaced-apart flanges on the other of said first and second housings cooperating with said lugs for transversely securing said first and second housings together when said second housing is placed to said first housing and said first and second housings are longitudinally displaced relative to each other; and at least one adjustable member carried by one of said first and second housings and cooperating with the other of said first and second housings for urging said first and second housings in longitudinally opposite directions.

2. The accessory mount according to claim 1, wherein:

said at least one adjustable member urges said first housing longitudinally toward the rear support.

3. The accessory mount according to claim 2, wherein:

said at least adjustable member urges said second housing longitudinally toward the front support.

4. The accessory mount according to claim 1, wherein:

at least one of said first and second housings includes a rail structure for mounting a firearm accessory thereto.

5. The accessory mount according to claim 1, wherein:

one of said first and second housings includes longitudinal channels along said lugs for slidingly containing said flanges of the other of said first and second housings.

6. The accessory mount according to claim 5, wherein:

said first housing is longitudinally urged toward the rear support when said first and second housings are longitudinally displaced.

7. The accessory mount according to claim 6, wherein:

said second housing is longitudinally urged toward the front support when said first and second housings are longitudinally displaced.

8. The accessory mount according to claim 5, wherein:

said rear end of said first housing is longitudinally urged against the rear support when said first and second housings are longitudinally displaced.

9. The accessory mount according to claim 8, wherein:

said front end of said second housing is longitudinally urged against said front support when said first and second housings are longitudinally displaced.

10. The accessory mount according to claim 5, wherein:

at least one of said first and second housings includes a rail structure for mounting a firearm accessory thereto.

11. An accessory mount for a firearm having a longitudinal barrel, a rear support and a front support, the accessory mount comprising the combination of:

a first semicylindrical mount housing having two longitudinal edges, an inner surface and a rear end, said first housing positionable along the barrel with said rear end supported by the rear support, said first housing including longitudinally spaced-apart lugs on said inner surface adjacent to each of said edges;

a second semicylindrical mount housing having two longitudinal edges and a front end, said second housing including longitudinally space-apart appendages adjacent to each of said edges of said second housing;

said lugs positioned on said first housing and said appendages positioned on said second housing for cooperation between said lugs and said appendages when said second housing is placed to said first housing, for transversely securing said first housing to said second housing with said first housing and said second housing longitudinally movable relative to each other; and at least one longitudinally adjustable member carried by one of said first housing and said second housing for urging said first housing and said second housing in longitudinally opposite directions.

12. The accessory mount according to claim 11, wherein:

said at least one longitudinally adjustable member urges said rear end of said first housing toward the rear support when said first housing is positioned along the barrel with said rear end of said first housing supported by the rear support and said second housing is transversely secured to said first housing.

13. The accessory mount according to claim 12, wherein:

said at least one longitudinally adjustable member urges said front end of said second housing toward the front support.

14. The accessory mount according to claim 11, wherein:

at least one of said first housing and said second housing includes a rail structure for mounting a firearm accessory thereto.

15. The accessory mount according to claim 11, wherein:

said at least one longitudinally adjustable member is carried by said second housing and cooperates with said first housing during adjustment thereof.

16. The accessory mount according to claim 11, wherein:

said first housing includes two longitudinal channels defined by said lugs respectively adjacent said longitudinal edges of said first housing and said appendages of said second housing include flanges slidingly contained in said channels when said second housing is laced to said first housing.

17. The accessory mount according to claim 16, wherein:

at least one of said first housing and said second housing includes a rail structure for mounting a firearm accessory thereto.

18. Firearm and accessory mount apparatus, comprising in combination:

a firearm including a longitudinal barrel, a rear support and a front support;

a first semicylindrical mount housing having two longitudinal edges, an inner surface and a rear end, said first housing positioned along said barrel with said rear end supported by said rear support, said first housing including longitudinally space-apart lugs on said inner surface adjacent to each of said edges;

a second semicylindrical mount housing having two longitudinal edges and a front end, said second housing including longitudinally spaced-apart appendages adjacent to each of said edges of said second housing, said second housing placed to said first housing with said appendages of said second housing cooperating with said lugs of said first housing for transversely securing said first housing to said second housing with said first housing and second housing longitudinally movable relative to each other; and at least one longitudinally adjustable member carried by one of said first housing and said second housing longitudinally urging said rear end of said first housing against said rear support and longitudinally urging said front end of said second housing against said front support.

19. The apparatus according to claim 18, wherein:

at least one of said first housing and said second housing includes a rail structure for mounting a firearm accessory thereto.

20. The apparatus according to claim 18, wherein:

said first housing includes two longitudinal channels defined by said lugs respectively adjacent to said longitudinal edges of said first housing; and said appendages of said second housing include flanges slidable contained in said channels.

21. The apparatus according to claim 20, wherein:

at least one of said first housing and said second housing includes a rail structure for mounting a firearm accessory thereto.

22. A method of installing an accessory mount to firearm, comprising the steps of:

providing a firearm having a longitudinal barrel, a rear support and a front support;

providing a first semicylindrical mount housing having two longitudinal edges, an inner surface, a rear end, and longitudinally spaced-apart lugs on said inner surface adjacent said longitudinal edges of said first housing, said lugs defining two longitudinal channels therealong;

positioning said first housing along said barrel with said rear end supported by said rear support;

providing a second semicylindrical mount housing having two longitudinal edges, a front end, and longitudinally spaced-apart appendages adjacent to each of said edges of said second housing, said appendages of said second housing including outwardly transverse flanges;

placing said second housing to said first housing with said flanges positioned between said lugs and with said flanges slidingly contained in said channels; and urging said first housing and said second housing in longitudinally opposite directions such that said flanges cooperate with said lugs for transversely securing said first and second housings to each other, said rear end is longitudinally urged against said rear support, and said front end is longitudinally urged against said front support.

23. The method according to claim 22, wherein:

during the housing providing steps, at least one of said first and second housings includes a rail structure for mounting a firearm accessory thereto.

24. An accessory mount for a firearm having a longitudinal barrel, a rear support and a front support, the accessory mount comprising the combination of:

a first longitudinal mount housing having a rear end, said first housing positionable along the barrel with said rear end of said first housing supported by the rear support;

a second longitudinal mount housing having a front end, said second housing positionable along the barrel with said front end of said second housing supported by said front support;

longitudinal channels is one of said first and second housings, and longitudinal flangs on the other of said first and second housings slidably received by said channels and transversely securing said first and second housing together; and at least one adjustable member carried by one of said first and second housings and cooperating with the other of said first and second housings for urging said first and second housings in longitudinally opposite directions.

25. The accessory mount according to claim 24, wherein:

at least one of said first and second housings includes a rail structure for mounting a firearm accessory thereto.

26. Firearm and accessory mount apparatus, comprising in combination:

a firearm including a longitudinal barrel, a rear support and a front support;

a first longitudinal mount housing having a rear end, said first housing positioned along said barrel with said rear end of said first housing supported by said rear support;

a second longitudinal mount housing having a front end, said second housing positioned along the barrel with said front end of said second housing supported by said front support;

longitudinal channels in one of said first and second housings, and longitudinal flanges on the other of said first and second housings slidable received by said channels and transversely securing said first and second housings together; and at least one adjustable member carried by one of said first and second housings and cooperating with the other of said first and second housings for urging said first and second housing in longitudinally opposite directions.

27. The apparatus according to claim 26, wherein:

said at least one adjustable member longitudinally urges said rear end of said first housing against said rear support and longitudinally urges said front end of said second housing against said front support.

28. The apparatus according to claim 26, wherein:

at least one of said first and second housings includes a rail structure for mounting a firearm accessory thereto.

* * * * *

UNITED STATES PATENT AND TRADEMARK OFFICE

CERTIFICATE OF CORRECTION

PATENT NO. : 6,779,288 B1
DATED : August 24, 2004
INVENTOR(S) : Paul Y. Kim and John W. Matthews It is certified that error appears in the above-identified patent and that said Letters Patent is hereby corrected as shown below:

Title page,
Item [75], Inventors, add -- ; John W. Matthews, Newport Beach, CA (US) --.

Drawings,
Sheet 2 of 4, replace with the attached corrected drawing sheet 2 of 4.

Column 5,
Line 23, the apostrophe should be deleted after "projections".

Column 9,
Line 5, "I claim" should be -- We claim --.
Line 34, -- one -- should be inserted after "least".

Column 10,
Line 7, "space-apart" should be -- spaced-apart --.
Line 46, "laced" should be -- placed --.

Column 11,
Line 21, "slidable" should be -- slidably --.

Column 12,
Line 13, "is" should be -- in --.
Line 40, "slidable" should be -- slidably --.

Signed and Sealed this

Twenty-fifth Day of October, 2005

JON W. DUDAS
*Director of the United States Patent and Trademark Office*